US008774695B2

(12) United States Patent
Ishizuka et al.

(10) Patent No.: US 8,774,695 B2
(45) Date of Patent: Jul. 8, 2014

(54) CLEANING DEVICE AND IMAGE-FORMING DEVICE

(75) Inventors: Kazuteru Ishizuka, Saitama (JP); Takashi Akazawa, Hachioji (JP); Daiki Yamanaka, Sagamihara (JP)

(73) Assignee: Konica Minolta Business Technologies, Inc. (JP)

( * ) Notice: Subject to any disclaimer, the term of this patent is extended or adjusted under 35 U.S.C. 154(b) by 294 days.

(21) Appl. No.: 13/104,116

(22) Filed: May 10, 2011

(65) Prior Publication Data

US 2011/0280637 A1 Nov. 17, 2011

(30) Foreign Application Priority Data

May 11, 2010 (JP) ..... 2010-109142

(51) Int. Cl.
*G03G 21/00* (2006.01)

(52) U.S. Cl.
USPC ..... 399/346

(58) Field of Classification Search
USPC ..... 399/346
See application file for complete search history.

(56) References Cited

FOREIGN PATENT DOCUMENTS

| | | | | |
|---|---|---|---|---|
| JP | 10-26916 | A | | 1/1998 |
| JP | 2002-341694 | A | | 11/2002 |
| JP | 2006084878 | A | * | 3/2006 |
| JP | 2008299091 | A | | 12/2008 |
| JP | 2009-109573 | A | | 5/2009 |
| JP | 2010-72162 | A | | 4/2010 |
| JP | 2010-97234 | A | | 4/2010 |
| JP | 2010117523 | A | * | 5/2010 |

OTHER PUBLICATIONS

State Intellectual Property Office of People's Republic of China; The First Office Action for Application No. 201110126463.9, Date of Mailing: Jun. 9, 2013 with English Translation.
Notification of Reasons for Refusal for Japanese Patent Application No. 2010-109142, mailed Oct. 29, 2013, with English translation.
Office Action for Chinese Patent Application No. 201110126463.9, mailed on Mar. 14, 2014. English translation attached.

* cited by examiner

*Primary Examiner* — Walter L Lindsay, Jr.
*Assistant Examiner* — Barnabas Fekete
(74) *Attorney, Agent, or Firm* — Cantor Colburn LLP

(57) ABSTRACT

A cleaning device comprises: a rotational brush disposed to touch an image holder and a lubricant, the brush which scrapes the lubricant and applies the scraped lubricant to the image holder, the brush including: a rotational axis; and a plurality of looped bristles disposed around the rotational axis, wherein a contact length of the bristles to the lubricant is longer than a contact length of the bristles to the image holder.

10 Claims, 10 Drawing Sheets

FIG. 8

| EXAMPLES | MATERIAL OF BRISTLES | SHAPE OF BRISTLES | SIZE OF BRISTLES | FIBER DENSITY OF BRISTLES | DIAMETER OF BRUSH | DISTANCE d | ANGLE α | N1 | N2 | RESULT |
|---|---|---|---|---|---|---|---|---|---|---|
| EXAMPLE1 | CONDUCTIVE POLYESTER | LOOP | 2.8DENIER | 180kF/inch^2 | 11.5mm | 0.71mm | 36° | 2.0N | 2.2N | NO |
| COMPARATIVE EXAMPLE1 | CONDUCTIVE POLYESTER | LOOP | 2DENIER | 180kF/inch^2 | 11.5mm | 0.71mm | 36° | 2.0N | 2.2N | SLIGHTLY |
| COMPARATIVE EXAMPLE2 | CONDUCTIVE POLYESTER | LOOP | 4DENIER | 180kF/inch^2 | 11.5mm | 0.71mm | 36° | 2.0N | 2.2N | SLIGHTLY |
| COMPARATIVE EXAMPLE3 | CONDUCTIVE POLYESTER | LOOP | 2.8DENIER | 100kF/inch^2 | 11.5mm | 0.71mm | 36° | 2.0N | 2.2N | SLIGHTLY |
| COMPARATIVE EXAMPLE4 | CONDUCTIVE POLYESTER | LOOP | 2.8DENIER | 180kF/inch^2 | 11mm | 0.71mm | 36° | 2.0N | 2.2N | SLIGHTLY |
| COMPARATIVE EXAMPLE5 | CONDUCTIVE POLYESTER | LOOP | 2.8DENIER | 180kF/inch^2 | 12mm | 0.71mm | 36° | 2.0N | 2.2N | SLIGHTLY |
| COMPARATIVE EXAMPLE6 | CONDUCTIVE POLYESTER | LOOP | 2.8DENIER | 180kF/inch^2 | 11mm | 0.71mm | 36° | 0.5N | 0.7N | SLIGHTLY |
| COMPARATIVE EXAMPLE7 | CONDUCTIVE POLYESTER | LOOP | 2.8DENIER | 180kF/inch^2 | 12mm | 0.71mm | 36° | 2.0N | 2.5N | SLIGHTLY |
| COMPARATIVE EXAMPLE8 | CONDUCTIVE POLYESTER | LOOP | 4DENIER | 70kF/inch^2 | 12mm | 0.71mm | 36° | 4.5N | 2.2N | OBVIOUS |
| COMPARATIVE EXAMPLE9 | CONDUCTIVE NYLON | STRAIGHT | 4DENIER | 100kF/inch^2 | 12mm | 0.71mm | 36° | 1.8N | 2.2N | OBVIOUS |

※ : DIFFERENT FROM EXAMPLE 1

FIG.9

| TEST SAMPLE | DISTANCE d | ANGLE α | RESULT |
|---|---|---|---|
| 1 | 0.5mm | 0° | NO |
| 2 | 0.5mm | 36° | NO |
| 3 | 0.5mm | 45° | SLIGHTLY |
| 4 | 0.5mm | 50° | OBVIOUS |
| 5 | 0.71mm | 0° | NO |
| 6 | 0.71mm | 36° | NO |
| 7 | 0.71mm | 45° | SLIGHTLY |
| 8 | 0.71mm | 70° | OBVIOUS |
| 9 | 0.75mm | 0° | NO |
| 10 | 0.75mm | 36° | NO |
| 11 | 0.75mm | 45° | SLIGHTLY |
| 12 | 0.75mm | 50° | OBVIOUS |
| 13 | 0.8mm | 36° | OBVIOUS |
| 14 | 0.94mm | 0° | OBVIOUS |
| 15 | 0.94mm | 36° | OBVIOUS |
| 16 | 0.94mm | 45° | OBVIOUS |
| 17 | 0.94mm | 50° | OBVIOUS |

CLEANING DEVICE AND IMAGE-FORMING DEVICE

BACKGROUND OF THE INVENTION

1. Field of the Invention

The present invention relates to a cleaning device and an image-forming device.

2. Description of the Related Art

Conventionally, there is known a cleaning device with a rotational brush and a solid lubricant. Furthermore, there exists an image-forming device with the cleaning device. The rotational brush touches a fixed lubricant, and scrapes the surface of the lubricant by rotating. The brush is arranged so as to touch an image holder, thereby applying the scraped lubricant onto the surface of the image holder.

For example, the following advantages are obtained by applying a lubricant on the surface of an image holder:

because of the applied lubricant, a toner image formed on the surface of the image holder separates easily from the surface thereof, and transferability of the toner image is improved;

abrasion of a remover (for example, a blade) which touches the surface of the image holder and removes residues on the surface thereof is suppressed by the lubricant, and removal performance of the remover is kept; and abrasion of the surface of the image holder caused by being touched by the brush and the blade is suppressed by the lubricant, and a sufficient life period of the image holder is ensured.

When a lubricant is applied non-uniformly on the surface of an image holder, a streak may be generated on an image formed on paper. For example, when a brush has straight bristles, the bristles may hold much toner remaining on the surface of an image holder. When the bristles hold much toner, the bristles can hold little lubricant. When the bristles hold little lubricant, the brush cannot apply the sufficient amount of lubricant on the surface of the image holder. As a result, the lubricant is applied non-uniformly onto the surface of the image holder.

FIG. 11 shows a cross-section diagram of a lubricant which is applied on the surface of an image holder uniformly, sectioned in the direction of a rotational axis of an image holder.

FIG. 12 shows a cross-section diagram of a lubricant which is applied on the surface of the image holder non-uniformly, sectioned in the direction of the rotational axis of the image holder.

As shown in FIG. 11, when a lubricant is applied uniformly in the direction of the rotational axis of the image holder, a streak is not generated on an image formed on paper. On the other hand, as shown in FIG. 12, when a lubricant is applied non-uniformly in the direction of the rotational axis of the image holder, a streak is generated on an image formed on paper.

For example, the following arts can apply a lubricant uniformly.

Japanese Patent Application Laid-open Publication No. 2009-109573 discloses a uniformizing member which is arranged behind a brush in the rotational direction of an image holder, wherein the uniformizing member uniformizes the lubricant applied by the brush on the surface of the image holder.

Japanese Patent Application Laid-open Publication No. Heisei 10-26916 discloses that looped bristles can hold more lubricant than toner remaining on the surface of an image holder, and that the size of bristles is defined and the bristles contact the surface of the image holder uniformly so that the lubricant can be applied thereto uniformly.

However, when a uniformizing member is arranged in a cleaning device, the cleaning device becomes large.

Furthermore, when looped bristles are used for a brush, scraping power of the brush increases, and the brush scrapes the lubricant applied on the surface of the image holder beforehand with the bristles thereof. As a result, the lubricant may not be uniformly applied on the surface of the image holder. That is to say, a lubricant cannot be applied uniformly on the surface of an image holder by only defining the size of bristles of a brush.

SUMMARY OF THE INVENTION

An object of the present invention is to provide a cleaning device and an image-forming device which can uniformly apply a lubricant on the surface of an image holder, and prevent a streak from being generated on an image.

In order to achieve at least one object mentioned above, a cleaning device reflecting one aspect of the present invention includes a rotational brush disposed to touch an image holder and a lubricant, the brush which scrapes the lubricant and applies the scraped lubricant to the image holder, the brush including: a rotational axis; and a plurality of looped bristles disposed around the rotational axis, wherein a contact length of the bristles to the lubricant is longer than a contact length of the bristles to the image holder.

Preferably, in the above cleaning device, a pressing force at which the lubricant presses the bristles is larger than a pressing force at which the bristles press the image holder.

Preferably, in the above cleaning device, the pressing force at which the lubricant presses the bristles is more than 0.7[N] and less than 2.5 [N].

Preferably, in the above cleaning device, the bristles are larger than 2 denier and smaller than 4 denier, fiber density of the bristles is more than 100 [kF/inch^2] and equal to or less than 180 [kF/inch^2], and a diameter of the brush is larger than 11 [mm] and smaller than 12 [mm].

Preferably, the above cleaning device further includes a pressing member which presses the lubricant on the brush.

Preferably, in the cleaning device, the lubricant is a solid lubricant.

Preferably, the above cleaning device further includes a remover behind the brush in a rotational direction of the image holder, the remover which removes a residue from the image holder.

An image-forming device reflecting another aspect of the present invention includes an image holder; a lubricant; and a rotational brush disposed to touch the image holder and the lubricant, the brush including: a rotational axis; and a plurality of looped bristles disposed around the rotational axis, wherein a contact length of the bristles to the lubricant is longer than a contact length of the bristles to the image holder.

Preferably, in the above image-forming device, a pressing force at which the lubricant presses the bristles is larger than a pressing force at which the bristles press the image holder.

BRIEF DESCRIPTION OF THE DRAWINGS

The present invention will more fully be understood by the following detailed description and the accompanying drawings, but those are only for description and are not intended to limit the scope of the present invention, wherein:

FIG. 8 is a table showing the material, size, and fiber density of bristles of a brush, the diameter of the brush, the distance d, the angle α, the pressing forces N1 and N2 of an example 1 and comparative examples 1-9, and results (a streak is generated or not) of experiment 1;

FIG. 9 is a table showing the distance d and the angle α of test samples 1-17, and results (a streak is generated or not) of experiment 2;

DETAILED DESCRIPTION OF THE PREFERRED EMBODIMENTS

A cleaning device and an image-forming device according to an embodiment of the present invention will be described in detail with reference to the accompanying drawings. The embodiment is an instance, and the present invention is not limited to the embodiment.

Figure 1:
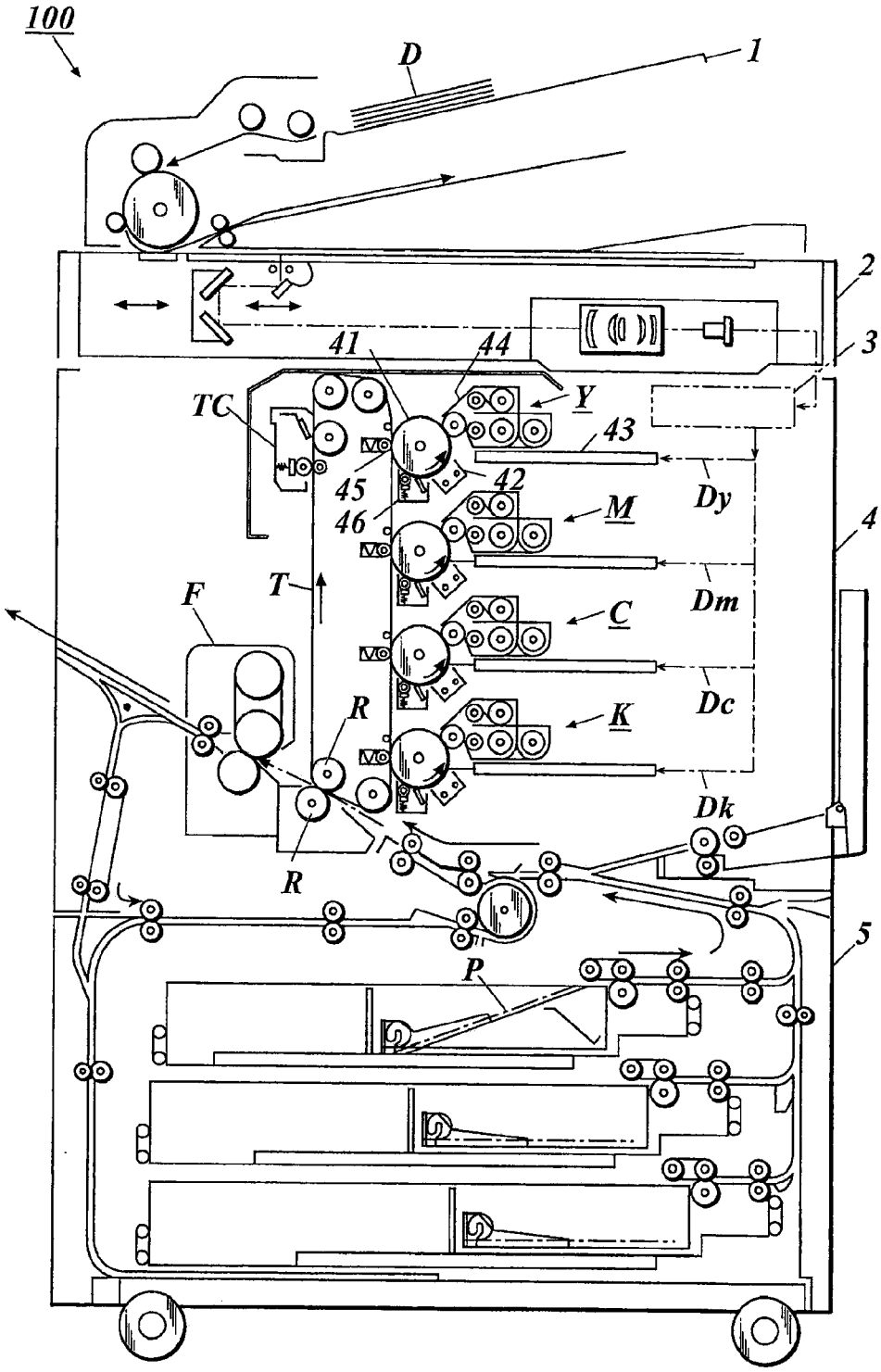
FIG. 1 is a schematic view showing a structure of a color image-forming device.

FIG. 1 shows a schematic view showing a structure of a color image-forming device 100.

The image-forming device 100 includes an automatic document feeder 1, a scanner 2, a controller 3, an image forming section 4, and a paper feeder 5.

The automatic document feeder 1 includes a paper path and a conveying roller conveying a document D which is set on a setting tray.

The scanner 2 is composed of an optical system including a light source, a reflector, a platen glass, a light receiving element, and the like. The light source emits light to the document D which passes through the paper path or is set on the platen glass. The light receiving element receives light reflected by the document D. The scanner 2 converts the intensity of the reflected light received by the light receiving element to an electric signal, and outputs the signal to the controller 3.

The controller 3 includes a CPU, a RAM, a ROM, and the like. The CPU controls overall behavior of the image-forming device 100 in cooperation with various programs stored in the RAM or the ROM. For example, the controller 3 generates image data (yellow image data Dy, magenta image data Dm, cyan image data Dc, and black image data Dk) based on the electric signal input from the scanner 2, and outputs the image data Dy, Dm, Dc, Dk to the image forming section 4. The controller 3 forms an image on paper P by controlling the behavior of the image forming section 4.

The image forming section 4 includes an image forming unit Y, an image forming unit M, an image forming unit C, an image forming unit K, an intermediate transfer belt T (image holder), secondary transfer rollers R, R, a cleaning device TC, and a fixing unit F.

Each of the image forming units Y, M, C, and K, has a photosensitive drum. The image forming unit Y forms a yellow toner image on the photosensitive drum, and transfers the yellow toner image to the intermediate transfer belt T (primarily transfer). The image forming unit M forms a magenta toner image on the photosensitive drum, and transfers the magenta toner image to the intermediate transfer belt T (primarily transfer). The image forming unit C forms a cyan toner image on the photosensitive drum, and transfers the cyan toner image to the intermediate transfer belt T (primarily transfer). The image forming unit K forms a black toner image on the photosensitive drum, and transfers the black toner image to the intermediate transfer belt T (primarily transfer).

The structure and the behavior of the image forming unit Y is shortly described below.

Because the structure and the behavior of the image forming units Y, M, C, and K are identical, the description of the structure and the behavior of the other image forming units M, C, and K are omitted.

The image forming unit Y includes a photosensitive drum 41 (image holder), a charging unit 42, an exposing unit 43, a developing unit 44, a primary transfer roller 45, and a cleaning device 46.

The photosensitive drum 41 has a cylindrical form and a diameter of 60 [mm]. The cylindrical drum has a photosensitive layer having a thickness of 25 [μm] on the surface of the cylindrical drum. The photosensitive layer includes an organic semiconductor layer and a charge transporting layer. The organic semiconductor layer includes polycarbonate and phthalocyanine pigment dispersed in the polycarbonate.

The charging unit 42 uniformly charges the surface of the photosensitive drum 41. The exposing unit 43 exposes the photosensitive drum 41 to a laser beam for removing the charge of an area of the surface of the photosensitive drum 41, the area corresponding to a white area of the document D, and forms an electrostatic latent image corresponding to the image data Dy.

The developing unit 44 uses a developer including two components, a toner and a carrier (two components developing method). The developing unit 44 applies the developer on the electrostatic latent image formed on the photosensitive drum 41, and forms a yellow toner image.

The primary transfer roller 45 is made of foamed material. The diameter of the primary transfer roller 45 is 22 [mm]. The primary transfer roller 45 is arranged across the intermediate transfer belt T from the photosensitive drum 41. The primary transfer roller 45 transfers the yellow toner image formed on the photosensitive drum 41 onto the intermediate transfer belt T (primarily transfer).

After the primarily transfer, the cleaning device 46 removes a residue such as a toner or a paper powder which remains on the surface of the photosensitive drum 41. The detailed structure of the cleaning device 46 is described below (see FIG. 2).

In the above, the structure and the behavior of the image forming unit Y are described.

The intermediate transfer belt T is a seamless belt made of semi-conductive resin. The intermediate transfer belt T is tensioned at 6 [kgf]. The intermediate transfer belt T rotates while holding YMCK toner images.

The secondary transfer rollers R, R are nip rollers of each of which the diameter is 24 [mm]. The secondary transfer rollers R, R nip the intermediate transfer belt T and the paper P fed by the paper feeder 5. The length of a part of the intermediate transfer belt T and a part of the paper P, the parts nipped by the secondary transfer rollers R, R, is 7 [mm]. The secondary transfer rollers R, R transfer all of the YMCK toner images held by the intermediate transfer belt T onto the paper P (secondary transfer).

After the secondary transfer, the cleaning device TC removes a residue such as a toner or a paper powder which remains on the intermediate transfer belt T. The structure and the behavior of the cleaning device TC and the cleaning device 46 are identical.

The fixing unit F heats and pressures the secondary transferred paper P, and fixes the transferred toner images on the paper P. After that, the paper P is fed to a predetermined paper path, and ejected from the color image-forming device 100.

Figure 2:
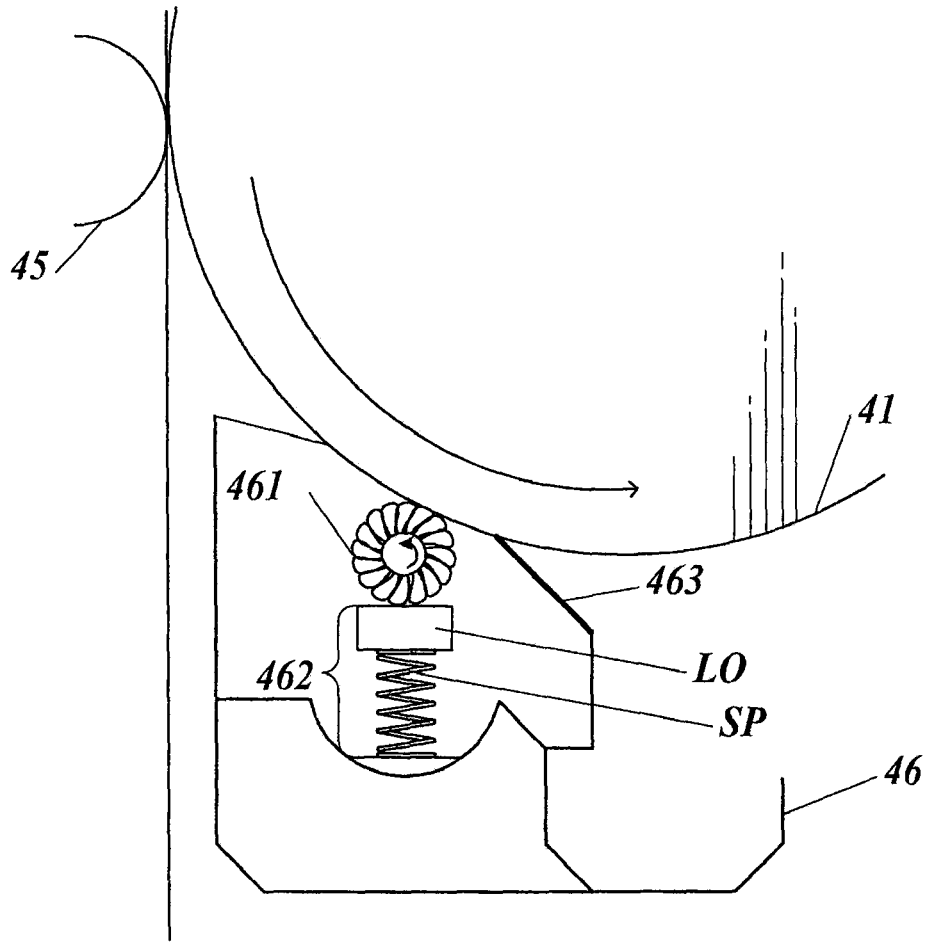
FIG. 2 is a schematic view showing a structure of a cleaning device.

FIG. 2 shows a schematic structure of the cleaning device 46.

The cleaning device 46 includes a rotational brush 461, a lubricant applying section 462, and a blade 463.

The brush 461 is a rotational brush including a rotational axis and bristles fixed around the rotational axis. The diameter of the rotational axis is 6 [mm], and the diameter of the brush is 11.5 [mm]. The bristles of the brush 461 touch the photosensitive drum 41 at a pressing force of 2.0 [N]. When the bristles touch the photosensitive drum 41 at the pressing force of 2.0 [N], a contact length of the bristles to the photosensitive drum 41 is equal to 1.0 [mm].

The brush 461 rotates in the same direction as the photosensitive drum 41, while making the bristles touch the surface of the photosensitive drum 41. The brush 461 touching the photosensitive drum 41 moves in the opposite direction to the photosensitive drum 41 at a contacting position of the brush 461 and the photosensitive drum 41, and removes the residue on the surface of the photosensitive drum 41 therefrom. The ratio of the surface velocity of the brush 461 to the surface velocity of the photosensitive drum 41 is 0.4.

The brush 461 touches a solid lubricant LO. The bristles of the brush 461 scrape the lubricant LO which is pressed on the bristles. The brush 461 applies the scraped lubricant LO to the photosensitive drum 41 when touching the photosensitive drum 41.

The lubricant applying section 462 includes the solid lubricant LO and a pressing member SP. The lubricant LO is fixed on the pressing member SP. The pressing member SP presses the lubricant LO on the bristles at a pressing force of 2.2 [N]. The solid lubricant LO is zinc stearate or the like. The pressing member SP may be a spring as illustrated in FIG. 2. As another example, a drive motor may be used for the pressing member SP. When the lubricant LO touches the bristles of the brush 461 at the pressing force of 2.2 [N], the contact length of the bristles to the lubricant LO is longer than 1.0 [mm].

The blade 463 is made of elastic material such as silicone rubber or polyurethane rubber. The edge of the blade 463 touches the photosensitive drum 41, so as to be directed in the opposite direction to the direction of rotation of the photosensitive drum 41. The blade 463 is arranged behind the brush 461 in the rotational direction of the photosensitive drum 41. The blade 463 removes a residue which stays on the surface of the photosensitive drum 41 after the brush 461 brushes the surface thereof with the scraped lubricant. The residue removed by the blade 463 is collected by a collecting screw (not shown).

Figure 3:
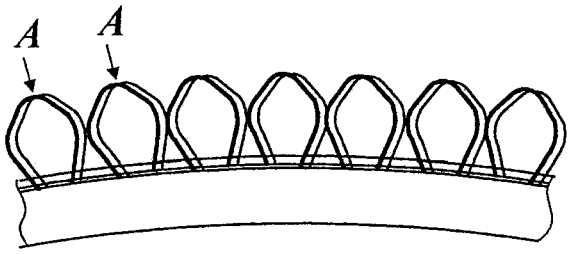
FIG. 3 is an enlarged view of bristles of a brush.

FIG. 3 is an enlarged view of the bristles of the brush 461.

The bristles are made of a yarn in which two monofilaments are wound. The yarn is fixed on the surface of the rotational axis of the brush 461 so that the yarn is looped to form looped bristles. The bristles are fixed at regular intervals so that the distance between the tops A of the looped bristles is not too short or too long. The distance between the tops A is described below (see FIG. 6).

The yarn is made of conductive material such as conductive polyester. For example, the electrical resistance of the yarn is 11.5 [log Ω], the fineness of the yarn is 210 decitex per 48 filaments, the size of the yarn is 2.8 denier, and the fiber density of the yarn is 180 [kF/inch^2]. The height of the looped bristles is 3 [mm].

However, the yarn is not limited to the above structure. For example, nylon or acrylic fiber can be used for the material of the brush 461. The fiber density of the bristles can be 120 [kF/inch^2].

[Uniformization by Pressing Force]

Figure 4A:
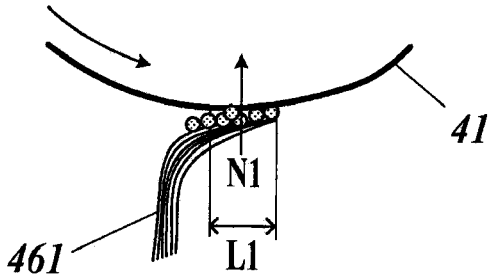
FIG. 4A is a view of a contact state of the bristles of the brush to a photosensitive drum when a pressing force N1 is smaller than a pressing force N2.
Figure 4B:
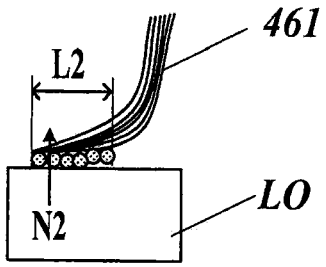
FIG. 4B is a view of a contact state of the bristles of the brush to a lubricant when the pressing force N1 is smaller than the pressing force N2.

FIGS. 4A and 4B show a contact state of the bristles of the brush 461 when a pressing force N1 at which the bristles press the photosensitive drum 41 is smaller than a pressing force N2 at which the lubricant LO presses the bristles. When the pressing force N1 is smaller than the pressing force N2, a contact length L1 of the bristles to the photosensitive drum 41 is shorter than a contact length L2 of the bristles to the lubricant LO. That is, only a part of each bristle, the part which holds a scraped lubricant scraped from the lubricant LO, touches the photosensitive drum 41. When the contact length L1 is shorter than the contact length L2, the bristles of the brush 461 can apply the scraped lubricant sufficiently and uniformly on the surface of the photosensitive drum 41.

Figure 5A:
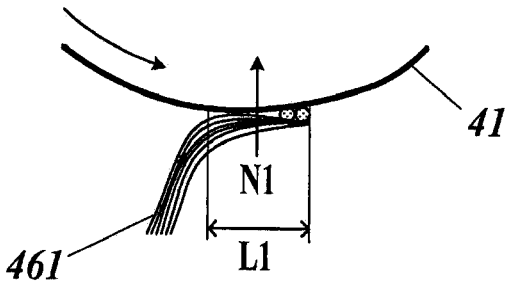
FIG. 5A is a view of a contact state of the bristles of the brush to the photosensitive drum when the pressing force N1 is larger than the pressing force N2.
Figure 5B:
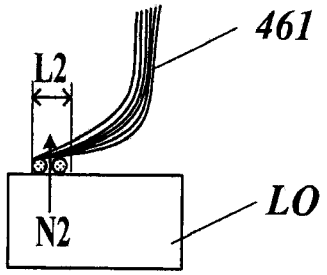
FIG. 5B is a view of a contact state of the bristles of the brush to the lubricant when the pressing force N1 is larger than the pressing force N2.

FIGS. 5A and 5B show a contact state of the bristles of the brush 461 when the pressing force N1 at which the bristles press the photosensitive drum 41 is larger than the pressing force N2 at which the lubricant LO presses the bristles as a comparative example.

When the pressing force N1 is smaller than the pressing force N2, the contact length L1 of the bristles to the photosensitive drum 41 is longer than the contact length L2 of the bristles to the lubricant LO. That is, a part of each bristle, the part which does not hold a scraped lubricant scraped from the lubricant LO, touches the photosensitive drum 41. When the contact length L1 is longer than the contact length L2, the bristles of the brush 461 may scrape a lubricant which is applied on the surface of the photosensitive drum 41 beforehand. Therefore, the bristles may not apply the scraped lubricant uniformly on the surface of the photosensitive drum 41.

[Uniformization by Distance and Angle]

Figure 6:
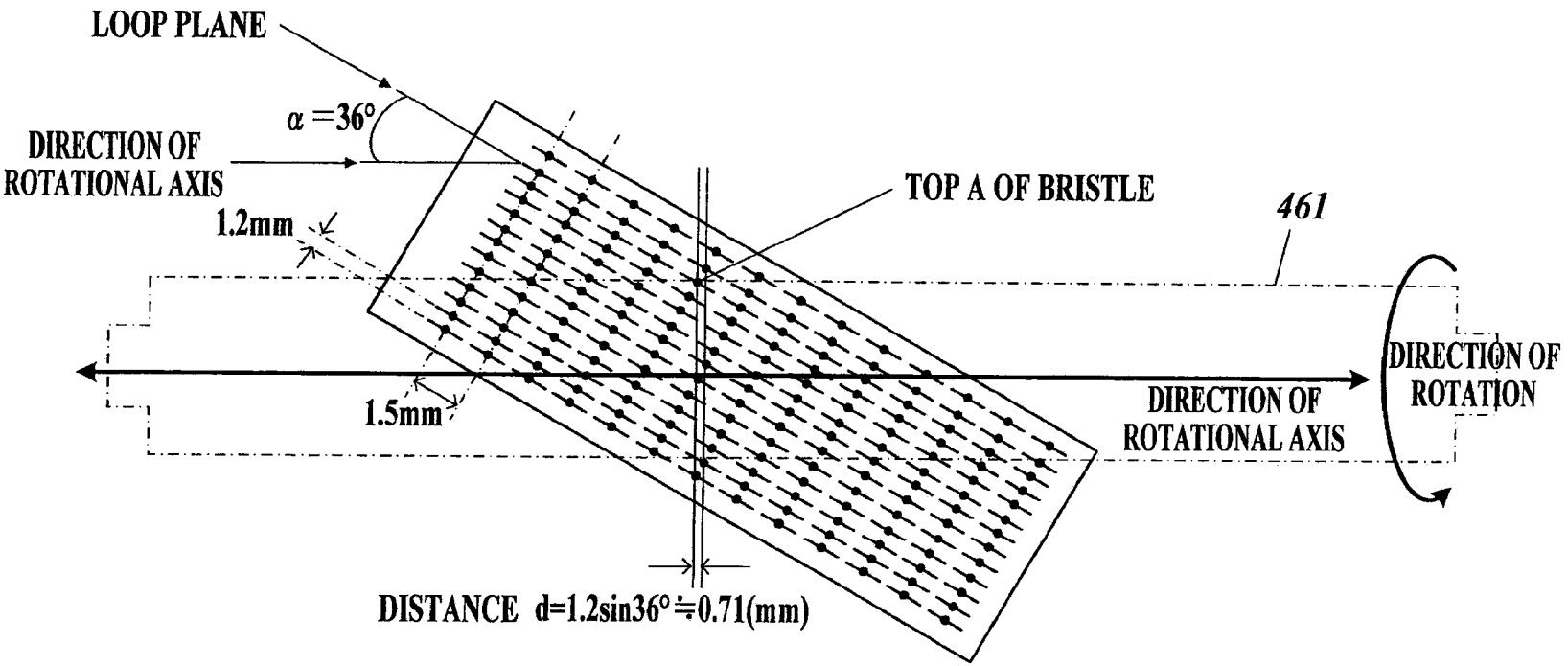
FIG. 6 is an opened-up view of a part of the surface of a rotational axis of the brush.

FIG. 6 is an opened-up view of a part of the surface of the rotational axis of the brush 461. As shown in FIG. 6, the looped bristles are fixed at regular intervals on the surface of the rotational axis. The distance d in FIG. 6 is defined as the shortest distance between the tops A of the bristles in the direction of the rotational axis. The angle α in FIG. 6 is defined as the angle between a plane including the looped bristles (loop plane) and the direction of the rotational axis. In FIG. 6, the angle α is equal to 36 degrees. In FIG. 6, the interval between the bristles in the direction parallel to the loop plane is equal to 1.5 [mm], and the interval between the bristles in the direction perpendicular to the loop plane is equal to 1.2 [mm]. Therefore, the distance d is equal to 0.71 [mm] which is obtained by multiplying 1.2 [mm] by sine 36 degrees. The bristles can apply the lubricant uniformly on the surface of the photosensitive drum 41 by defining the distance d and the angle α adequately.

In FIG. 6, the loop plane is illustrated as a downward-sloping straight line, but it is not limited thereto. It may be illustrated as an upward-sloping straight line.

Figure 7:
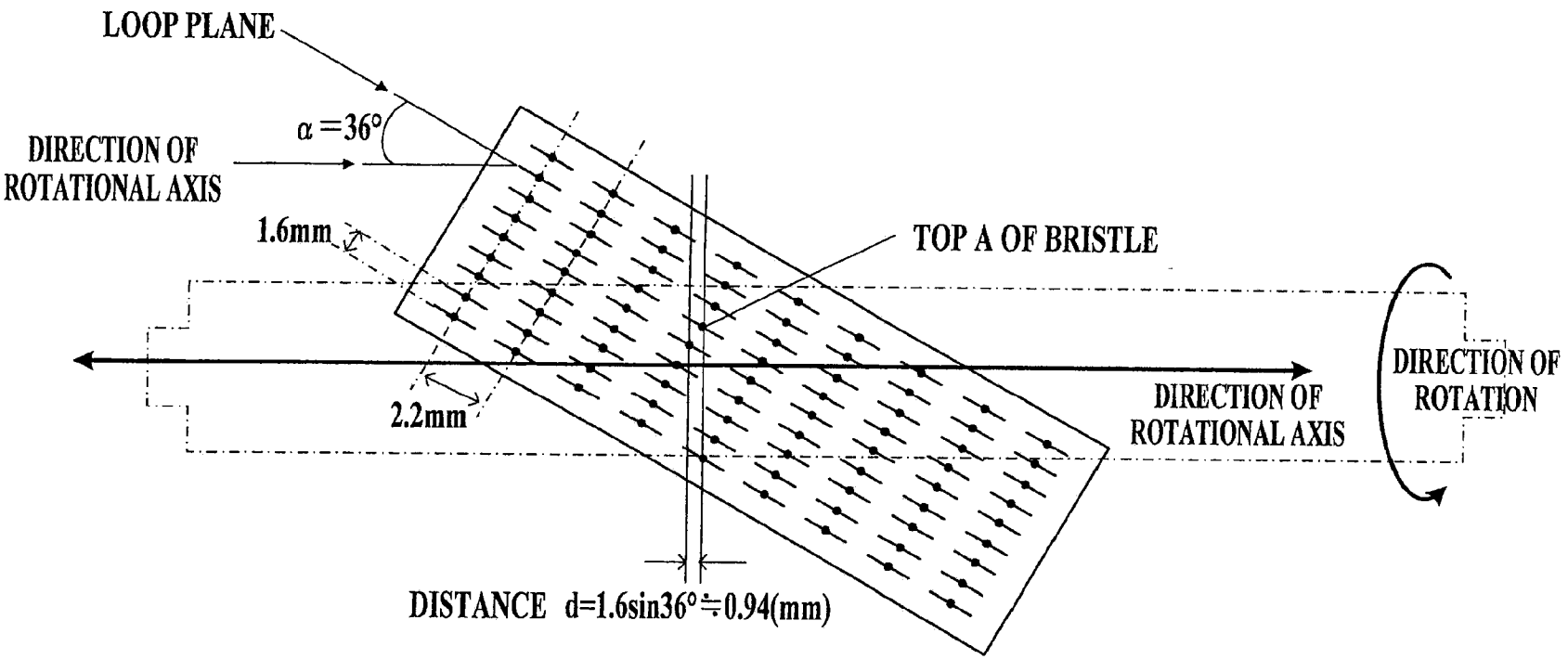
FIG. 7 is an opened-up view of a part of the surface of a rotational axis of a brush according to a comparative example.

FIG. 7 is an opened-up view of a part of the surface of a rotational axis of a brush which is a comparative example.

In the comparative example illustrated in FIG. 7, the interval between bristles in the direction parallel to the loop plane is equal to 2.2 [mm], the interval between the bristles in the direction perpendicular to the loop plane is equal to 1.6 [mm], and the angle α is equal to 36 degrees. Therefore, in FIG. 7, the distance d is equal to 0.94 [mm] which is obtained by multiplying 1.6 [mm] by sine 36 degrees.

Although the angle α of the comparative example illustrated in FIG. 7 is equal to the angle α of the example illustrated in FIG. 6, the distance d of the comparative example illustrated in FIG. 7 is longer than the distance d of the example illustrated in FIG. 6. Therefore, the density of the bristles on the surface of the rotational axis is so low that the bristles may apply the lubricant LO on the surface of the photosensitive drum 41 non-uniformly.

EXPERIMENT 1

FIG. 8 is a table showing the material, size, and fiber density of bristles of a brush, the diameter of the brush, the distance d, the angle α, the pressing forces N1 and N2 of example 1 and comparative examples 1-9, and results (a streak is generated or not) of experiment 1. Hatched parts in FIG. 8 show parameters different from example 1.

The brush of example 1 is identical to the brush 461 according to the embodiment.

With regard to comparative example 1, the size of the bristles is thinner than that of the brush 461.

With regard to comparative example 2, the size of the bristles is thicker than that of the brush 461.

With regard to comparative example 3, the fiber density of the bristles is lower than that of the brush 461.

With regard to comparative example 4, the diameter of the brush is smaller than that of the brush 461.

With regard to comparative example 5, the diameter of the brush is larger than that of the brush 461.

With regard to comparative example 6, the diameter of the brush is smaller than that of the brush 461, the pressing force N1 is smaller than the pressing force N2 (see FIG. 4), and the pressing force N2 is smaller than that of the brush 461.

With regard to comparative example 7, the diameter of the brush is larger than that of the brush 461, the pressing force N1 is smaller than the pressing force N2 (see FIG. 4), and the pressing force N2 is larger than that of the brush 461.

With regard to comparative example 8, the size of the bristles is thicker than that of the brush 461, the fiber density of the bristles is lower than that of the brush 461, the diameter of the brush is larger than that of the brush 461, and the pressing force N1 is larger than the pressing force N2.

With regard to comparative example 9, the bristles are straight bristles, the material of the bristles is conductive nylon, the size of the bristles is thicker than that of the brush 461, the fiber density of the bristles is lower than that of the brush 461, the diameter of the brush is larger than that of the brush 461, the pressing force N1 is smaller than the pressing force N2 (see FIG. 4), and the pressing force N1 is smaller than that of the brush 461.

The structure of comparative examples 1-9 is similar to example 1 except for the parameters of FIG. 8.

A3 size documents on which the ratio of an area of printing is 0.5% were set on the image-forming device including the cleaning device using the above brush of example 1 or one of comparative examples 1-9. The documents were conveyed continuously, and it was observed whether a streak was generated on an image of ejected paper or not.

The results of example 1 and comparative examples 1-9 are shown in FIG. 8. In FIG. 8, "no" represents that a streak was not generated on an image, "slightly" represents that a streak was "slightly" generated on an image, and "obviously" represents that a streak was obviously generated on an image.

As a result of experiment 1, in the case of example 1, a streak was not generated on the image. In the case of each of comparative examples 1-7, a streak was slightly generated on an image. In the case of each of comparative examples 8 and 9, a streak was obviously generated on an image.

As described above, according to experiment 1, when the contact length L2 is longer than the contact length L1, the scraped lubricant LO can be applied uniformly on the surface of the photosensitive drum 41. Accordingly, the generation of streaks on an image can be prevented.

Furthermore, as shown in FIGS. 4A and 4B, the brush 461, the lubricant LO and the photosensitive drum 41 are arranged in such a way that the pressing force N1 is smaller than the pressing force N2, and thereby, the contact length L1 can be shorter than the contact length L2, and the generation of streaks on an image can be prevented.

Moreover, the size of the bristles is set to 2 to 4 denier, the fiber density thereof is set to 100 to 180 [kF/inch^2], and the diameter of the brush 461 is set to 11 to 12 [mm]. Thereby, the contact length L1 can be shorter than the contact length L2, and the generation of streaks on an image can be prevented.

Furthermore, the pressing force N2 is set in the range of 0.7 [N] to 2.5 M. Thereby, the contact length L1 can be shorter than the contact length L2, and the generation of streaks on an image can be prevented.

EXPERIMENT 2

FIG. 9 is a table showing the distance d and the angle α of test samples 1-17, and results (a streak is generated or not) of experiment 2.

With regard to test samples 1-4, the distance d is 0.5 [mm]. With regard to test sample 1, the angle α is 0 degrees. With regard to test sample 2, the angle α is 36 degrees. With regard to test sample 3, the angle α is 45 degrees. With regard to test sample 4, the angle α is 50 degrees.

With regard to test samples 5-8, the distance d is 0.71 [mm]. With regard to test sample 5, the angle α is 0 degrees. With regard to test sample 6, the angle α is 36 degrees. With regard to test sample 7, the angle α is 45 degrees. With regard to test sample 8, the angle α is 70 degrees. The brush of test sample 6 is identical to the brush 461 according to the present embodiment.

With regard to test samples 9-12, the distance d is 0.75 [mm]. With regard to test sample 9, the angle α is 0 degrees. With regard to test sample 10, the angle α is 36 degrees. With regard to test sample 11, the angle α is 45 degrees. With regard to test sample 12, the angle α is 50 degrees.

With regard to test sample 13, the distance d is 0.8 [mm], and the angle α is 36 degrees.

With regard to test samples 14-17, the distance d is 0.94 [mm]. With regard to test sample 14, the angle α is 0 degrees. With regard to test sample 15, the angle α is 36 degrees. With regard to test sample 16, the angle α is 45 degrees. With regard to test sample 17, the angle α is 50 degrees. The structure of test samples 1-17 is similar to the brush 461 of the embodiment except for the parameters of FIG. 9.

A3 size documents on which the ratio of an area of printing is 0.5% were set on the image-forming device including the cleaning device using the above brush of one of test samples 1-17. The documents were conveyed continuously, and it was observed whether a streak was generated on an image of ejected paper or not.

The results of test samples 1-17 are shown in FIG. 9. In FIG. 9, "no" represents that a streak was not generated on an image, "slightly" represents that a streak was slightly generated on an image, and "obviously" represents that a streak was obviously generated on an image.

Figure 10:
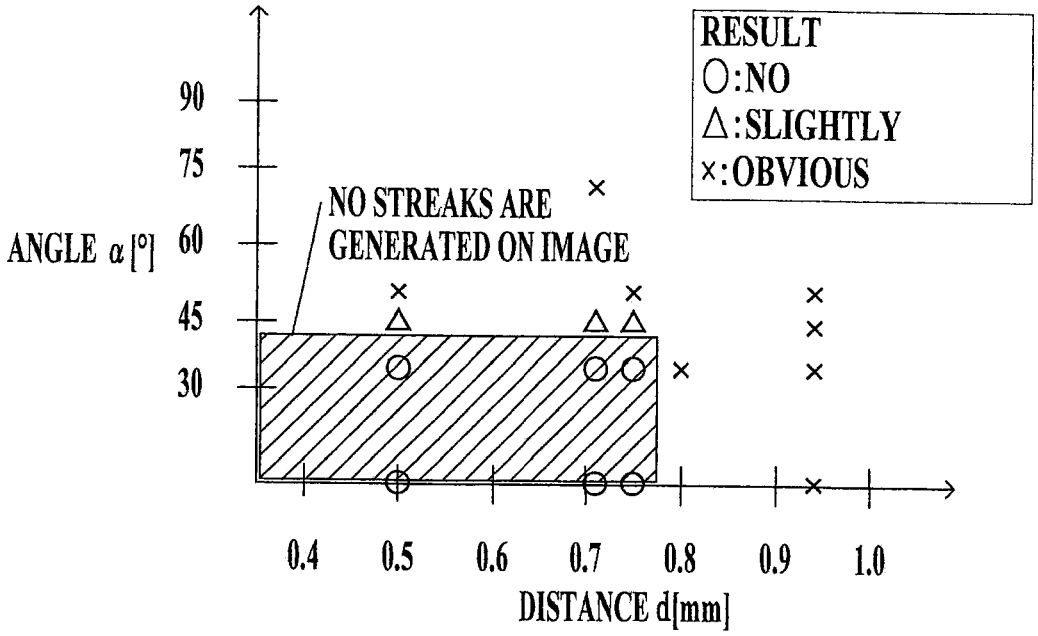
FIG. 10 is a scatter chart on which the results of experiment 2 are plotted.
Figure 11:
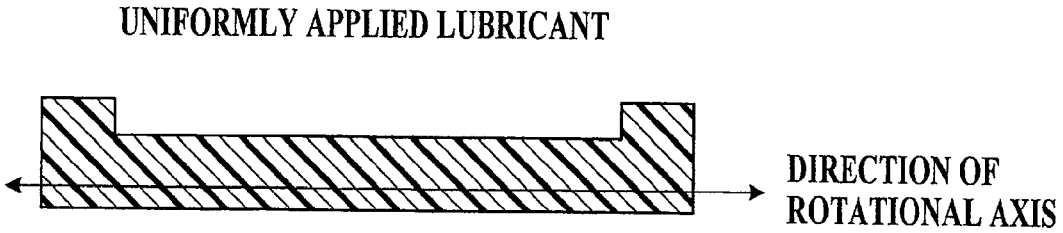
FIG. 11 is a cross-section diagram of the lubricant which is applied on the surface of an image holder uniformly, sectioned in the direction of the rotational axis of the image holder.
Figure 12:
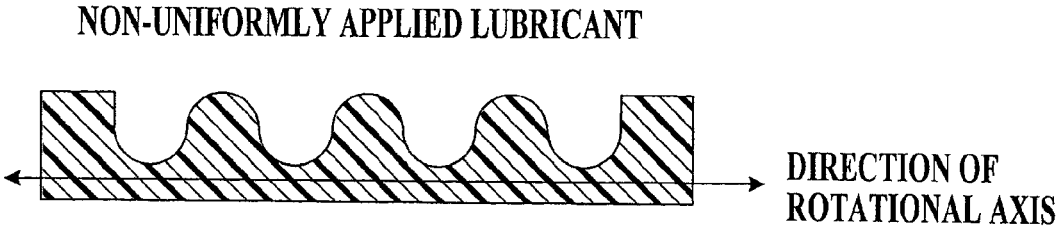
FIG. 12 is a cross-section diagram of the lubricant which is applied on the surface of the image holder non-uniformly, sectioned in the direction of the rotational axis of the image holder.

FIG. 10 is a scatter chart on which the results of experiment 2 are plotted. The coordinate of the horizontal axis means the distance d, and the coordinate of the vertical axis means the angle α. With regard to the marks "○", "□", and "x" plotted in FIG. 10, "○" means the result of "no" which represents that a streak was not generated on an image, "□" means the result of "slightly" which represents that a streak was "slightly" generated on an image, and "x" means the result of "obviously" which represents that a streak was obviously generated on an image.

A hatched area in FIG. 10 shows the range of the distance d and the angle α, the range in which no streak was generated on an image. According to the scatter chart of FIG. 10, the border between the area in which a streak is generated on the image and the area in which no streak is generated on an image is likely to exist between 0.75 [mm] and 0.8 [mm] with regard to the distance d, and between 36 degrees and 45 degrees with regard to the angle α.

Experiment 2 shows that, as described above, a brush of which bristles are fixed on the surface of a rotational axis in such a way that the distance d is shorter than 0.75 [mm] and the angle α is smaller than 45 degrees can apply the scraped lubricant uniformly onto the surface of the photosensitive drum 41. Therefore, the generation of a streak on an image can be prevented.

According to one aspect of a preferable embodiment of the present invention, a cleaning device including a rotational brush disposed to touch an image holder and a lubricant, the brush which scrapes the lubricant and applies the scraped lubricant to the image holder, the brush including: a rotational axis; and a plurality of looped bristles disposed around the rotational axis, wherein a contact length of the bristles to the lubricant is longer than a contact length of the bristles to the image holder is provided.

The cleaning device can apply the scraped lubricant onto the surface of the image holder, and prevent the generation of streaks on an image.

Preferably, in the above cleaning device, a pressing force at which the lubricant presses the bristles is larger than a pressing force at which the bristles press the image holder.

Preferably, in the above cleaning device, the pressing force at which the lubricant presses the bristles is more than 0.7[N] and less than 2.5 [N].

Preferably, in the above cleaning device, the bristles are larger than 2 denier and smaller than 4 denier, fiber density of the bristles is more than 100 [kF/inch^2] and equal to or less than 180 [kF/inch^2], and a diameter of the brush is larger than 11 [mm] and smaller than 12[mm].

Preferably, the above cleaning device further includes a pressing member which presses the lubricant on the brush.

Preferably, in the cleaning device, the lubricant is a solid lubricant.

Preferably, the above cleaning device further includes a remover behind the brush in a rotational direction of the image holder, the remover which removes a residue from the image holder.

Moreover, according to another aspect of a preferable embodiment of the present invention, an image-forming device reflecting another aspect of the present invention including an image holder; a lubricant; and a rotational brush disposed to touch the image holder and the lubricant, the brush including: a rotational axis; and a plurality of looped bristles disposed around the rotational axis, wherein a contact length of the bristles to the lubricant is longer than a contact length of the bristles to the image holder is provided.

The image-forming device can apply the scraped lubricant onto the surface of the image holder, and prevent the generation of streaks on an image.

Preferably, in the above image-forming device, a pressing force at which the lubricant presses the bristles is larger than a pressing force at which the bristles press the image holder.

The entire disclosure of Japanese Patent Application No. 2010-109142 filed on May 11, 2010 including description, claims, drawings, and abstract are incorporated herein by reference in its entirety.

Although various exemplary embodiments have been shown and described, the invention is not limited to the embodiments shown. Therefore, the scope of the invention is intended to be limited solely by the scope of the claims that follow.

What is claimed is:

1. A cleaning device comprising:

a rotational brush disposed to touch an image holder and a lubricant, the brush which scrapes the lubricant and applies the scraped lubricant to the image holder, the brush including:

a rotational axis; and a plurality of looped bristles disposed around the rotational axis, wherein a contact length of the bristles to the lubricant is longer than a contact length of the bristles to the image holder, and wherein a pressing force at which the lubricant presses the bristles is larger than a pressing force at which the bristles press the image holder and is more than 0.7[N] and less than 2.5 [N].

2. The cleaning device of claim 1, further comprising a pressing member which presses the lubricant on the brush.

3. The cleaning device of claim 1, wherein the lubricant is a solid lubricant.

4. The cleaning device of claim 1, further comprising a remover behind the brush in a rotational direction of the image holder, the remover which removes a residue from the image holder.

5. An image-forming device comprising:

an image holder;

a lubricant; and a rotational brush disposed to touch the image holder and the lubricant, the brush including:

a rotational axis; and a plurality of looped bristles disposed around the rotational axis, wherein a contact length of the bristles to the lubricant is longer than a contact length of the bristles to the image holder, and wherein a pressing force at which the lubricant presses the bristles is larger than a pressing force at which the bristles press the image holder and is more than 0.7[N] and less than 2.5 [N].

6. A cleaning device comprising:

a rotational brush disposed to touch an image holder and a lubricant, the brush which scrapes the lubricant and applies the scraped lubricant to the image holder, the brush including:

a rotational axis; and a plurality of looped bristles disposed around the rotational axis, wherein a contact length of the bristles to the lubricant is longer than a contact length of the bristles to the image holder, and wherein the bristles are larger than 2 denier and smaller than 4 denier, fiber density of the bristles is more than 100 [kF/inch^2] and equal to or less than 180 [kF/inch^2], and a diameter of the brush is larger than 11 [mm] and smaller than 12[mm].

7. The cleaning device of claim 6, further comprising a pressing member which presses the lubricant on the brush.

8. The cleaning device of claim 6, wherein the lubricant is a solid lubricant.

9. The cleaning device of claim 6, further comprising a remover behind the brush in a rotational direction of the image holder, the remover which removes a residue from the image holder.

10. An image-forming device comprising:

an image holder;

a lubricant; and a rotational brush disposed to touch the image holder and the lubricant, the brush including:

a rotational axis; and a plurality of looped bristles disposed around the rotational axis, wherein a contact length of the bristles to the lubricant is longer than a contact length of the bristles to the image holder, and wherein the bristles are larger than 2 denier and smaller than 4 denier, fiber density of the bristles is more than 100 [kF/inch^2] and equal to or less than 180 [kF/inch^2], and a diameter of the brush is larger than 11 [mm] and smaller than 12[mm].

* * * * *